US012767286B2

(12) United States Patent
Sele et al.

(10) Patent No.: US 12,767,286 B2
(45) Date of Patent: Oct. 20, 2026

(54) FLOATING STRUCTURE

(71) Applicant: SEATRIUM (SG) PTE. LTD., Singapore (SG)

(72) Inventors: Hans Olav Sele, Oslo (NO); Oda Emilie Nilseng Danielsen, Oslo (NO); Otto Skjåstad, Kolbjornsvik (NO); Cher Kiang Jason Chia, Singapore (SG)

(73) Assignee: SEATRIUM (SG) PTE. LTD., Singapore (SG)

( * ) Notice: Subject to any disclaimer, the term of this patent is extended or adjusted under 35 U.S.C. 154(b) by 428 days.

(21) Appl. No.: 18/287,847

(22) PCT Filed: Apr. 20, 2022

(86) PCT No.: PCT/SG2022/050233
§ 371 (c)(1),
(2) Date: Oct. 20, 2023

(87) PCT Pub. No.: WO2022/225457
PCT Pub. Date: Oct. 27, 2022

(65) Prior Publication Data

US 2024/0359778 A1 Oct. 31, 2024

(30) Foreign Application Priority Data

Apr. 21, 2021 (SG) ..... 10202104059Q

(51) Int. Cl.
*B63B 35/44* (2006.01)
*B63B 21/50* (2006.01)
*B63B 39/02* (2006.01)

(52) U.S. Cl.
CPC ..... *B63B 35/44* (2013.01); *B63B 21/50* (2013.01); *B63B 39/02* (2013.01); *B63B 2035/446* (2013.01)

(58) Field of Classification Search
CPC ..... B63B 35/44; B63B 21/50; B63B 39/02; B63B 2035/446; B63B 1/048;
(Continued)

(56) References Cited

U.S. PATENT DOCUMENTS 1,046,541 A 12/1912 Bates
8,471,396 B2 6/2013 Roddier et al.
(Continued)

FOREIGN PATENT DOCUMENTS

CN 103925172 A 7/2014
CN 108757336 A 11/2018
(Continued)

OTHER PUBLICATIONS

International Search Report for PCT Application No. PCT/SG2022/050902, dated Jun. 1, 2023.
(Continued)

*Primary Examiner* — Andrew Polay
(74) *Attorney, Agent, or Firm* — Morse, Barnes-Brown & Pendleton P.C.; Lisa M. Warren, Esq.; Russell L. Widom

(57) ABSTRACT

According to embodiments of the present invention, a floating structure is provided. The floating structure includes an open top end; an open bottom end opposite the open top end; an annular wall extending between the open top end and the open bottom end; and a cylindrical structure arranged off center of the floating structure and configured to support a tower. The annular wall forms a circumferential peripheral of the floating structure to provide a central moonpool. At least part of the cylindrical structure extends alongside and coupled to the annular wall. According to further embodiments, an apparatus including the floating structure and a tower supported by a cylindrical structure of the floating structure is also provided.

17 Claims, 9 Drawing Sheets

(58) Field of Classification Search
CPC ..... B63B 1/041; B63B 2039/067; B63B 2207/02; B63B 2241/06; B63B 2241/08; B63B 2241/12; B63B 2241/16
See application file for complete search history.

(56) References Cited

U.S. PATENT DOCUMENTS

| | | | | |
|---|---|---|---|---|
| 8,601,748 | B2 | 12/2013 | Delago et al. | |
| 8,959,870 | B2 | 2/2015 | Schmidt | |
| 9,180,941 | B1 | 11/2015 | Vandenworm | |
| 9,297,206 | B2 | 3/2016 | Vandenworm | |
| 9,518,564 | B2 | 12/2016 | Dagher et al. | |
| 10,215,161 | B2 | 2/2019 | Viselli et al. | |
| 10,300,993 | B2 | 5/2019 | Vandenworm | |
| 12,055,125 | B2 | 8/2024 | Low et al. | |
| 12,202,574 | B2 | 1/2025 | Wang et al. | |
| 2007/0243063 | A1 | 10/2007 | Schellstede | |
| 2012/0131880 | A1 | 5/2012 | Delago et al. | |
| 2012/0183359 | A1 | 7/2012 | Nordstrom et al. | |
| 2013/0091784 | A1 | 4/2013 | Schmidt | |
| 2014/0196654 | A1 * | 7/2014 | Roddier | F03D 9/25 290/55 |
| 2014/0311085 | A1 | 10/2014 | Fernandez Gomez et al. | |
| 2016/0230746 | A1 | 8/2016 | Dagher et al. | |
| 2022/0348288 | A1 | 11/2022 | Wang et al. | |
| 2023/0034804 | A1 | 2/2023 | Low et al. | |
| 2024/0208619 | A1 | 6/2024 | Hasholt | |
| 2025/0042518 | A1 | 2/2025 | Sreedharan et al. | |

FOREIGN PATENT DOCUMENTS

| | | | | | |
|---|---|---|---|---|---|
| CN | 110949633 | A | * | 4/2020 | B63B 35/44 |
| EP | 3170730 | A1 | | 5/2017 | |
| EP | 3209548 | B1 | | 9/2019 | |
| GB | 2561612 | A | | 10/2018 | |
| GB | 2624065 | A | * | 5/2024 | F03D 13/256 |
| KR | 20140075892 | A | | 6/2014 | |
| WO | 2013155521 | A1 | | 10/2013 | |
| WO | 2014013097 | A1 | | 1/2014 | |
| WO | 2019/088325 | A1 | | 5/2019 | |
| WO | 2019204895 | A2 | | 10/2019 | |

OTHER PUBLICATIONS

International Search Report for PCT Application No. PCT/SG2021/050825, dated Mar. 31, 2022.
Notice of Allowance from U.S. Appl. No. 17/720,850, dated Sep. 19, 2024.
Notice of Allowance from U.S. Appl. No. 17/784,714, dated Apr. 8, 2024.
International Preliminary Report on Patentability for PCT Application No. PCT/SG2022/050233, dated Jun. 15, 2023.
International Preliminary Report on Patentability for PCT Application No. PCT/SG2021/050003, dated Apr. 20, 2022.
Non-Final Office Action issued in U.S. Appl. No. 18/717,416, dated Jun. 2, 2026.

* cited by examiner

FLOATING STRUCTURE

CROSS-REFERENCE TO RELATED APPLICATIONS

This application, is a national stage filing under 35 U.S.C. 371 of International Application No. PCT/SG2022/050233, filed Apr. 20, 2022, which claims the benefit of priority of Singapore patent application No. 10202104059Q, filed 21 Apr. 2021, the content of it being hereby incorporated by reference in its entirety for all purposes.

TECHNICAL FIELD

Various embodiments relate to a floating structure, more specifically for facilitating support of a tower, and an apparatus including such floating structure and tower supported by the floating structure.

BACKGROUND

Market for offshore wind power has increased significantly and continues to be on the raise as harnessing power from the wind remains as one of the cleanest and most sustainable ways to generate electricity. Harvesting wind power is moving to deeper waters where the wind resources are better and more abundant as compared to onshore or nearshore locations. To do so, a floating offshore wind turbine (FOWT) would be required as installing a fixed or piled offshore wind turbine becomes much more challenging or even impossible in deeper waters.

Several concepts of FOWT have been developed.

For example, a prior publication, CN212022920U describes a wave-absorbing foundation offshore wind turbine that includes a tower column centrally received by an underwatering floating cabin. Other publications such as US 2020300224A1 and CN 112177859A describe towers sitting on top deck of respective floating platforms.

Floating foundations with large moonpools are also explored, with a need to improve their stability when installed with wind turbine(s).

SUMMARY

According to an embodiment, a floating structure is provided. The floating structure may include an open top end; an open bottom end opposite the open top end; an annular wall extending between the open top end and the open bottom end, wherein the annular wall forms a circumferential peripheral of the floating structure to provide a central moonpool; and a cylindrical structure arranged off center of the floating structure and configured to support a tower. At least part of the cylindrical structure extends alongside and coupled to the annular wall.

According to an embodiment, an apparatus including the floating structure according to various embodiments, and a tower is provided. The tower is supported by a cylindrical structure of the floating structure, and a wind turbine is attached to a distal end of the tower.

BRIEF DESCRIPTION OF THE DRAWINGS

In the drawings, like reference characters generally refer to like parts throughout the different views. The drawings are not necessarily to scale, emphasis instead generally being placed upon illustrating the principles of the invention. In the following description, various embodiments of the invention are described with reference to the following drawings, in which.

DETAILED DESCRIPTION

The following detailed description refers to the accompanying drawings that show, by way of illustration, specific details and embodiments in which the invention may be practiced. These embodiments are described in sufficient detail to enable those skilled in the art to practice the invention. Other embodiments may be utilized and structural, logical, and electrical changes may be made without departing from the scope of the invention. The various embodiments are not necessarily mutually exclusive, as some embodiments can be combined with one or more other embodiments to form new embodiments.

Embodiments described in the context of one of the methods or devices are analogously valid for the other methods or devices. Similarly, embodiments described in the context of a method are analogously valid for a device, and vice versa.

Features that are described in the context of an embodiment may correspondingly be applicable to the same or similar features in the other embodiments. Features that are described in the context of an embodiment may correspondingly be applicable to the other embodiments, even if not explicitly described in these other embodiments. Furthermore, additions and/or combinations and/or alternatives as described for a feature in the context of an embodiment may correspondingly be applicable to the same or similar feature in the other embodiments.

In the context of various embodiments, the articles "a", "an" and "the" as used with regard to a feature or element include a reference to one or more of the features or elements.

In the context of various embodiments, the phrase "substantially" may include "exactly" and a reasonable variance.

In the context of various embodiments, the term "about" or "approximately" as applied to a numeric value encompasses the exact value and a reasonable variance.

As used herein, the term "and/or" includes any and all combinations of one or more of the associated listed items.

As used herein, the phrase of the form of "at least one of A or B" may include A or B or both A and B. Correspondingly, the phrase of the form of "at least one of A or B or C", or including further listed items, may include any and all combinations of one or more of the associated listed items.

As used herein, the expression "configured to" may mean "constructed to" or "arranged to".

Various embodiments provide a floating structure with a central moonpool and a support of a tower to the floating structure. For example, the tower may be a vertical tower or mast of a wind turbine. Having a cylindrical floating structure with a large moonpool, a FOWT may be provided. In the context of various embodiments, the term "cylindrical" refer to the floating structure having straight parallel vertical sides and a horizontal cross-section that is regularly circular, or irregularly circular, or regularly polygonal (multifaced), or irregularly polygonal (multifaced).

Figure 1A:
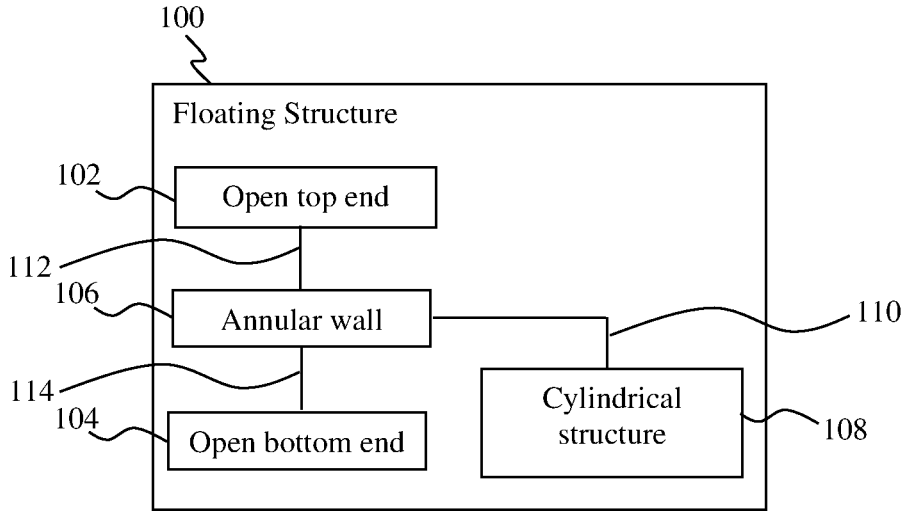
FIG. 1A shows a schematic view of a floating structure, according to various embodiments.

In FIG. 1A, a floating structure 100, in accordance with various embodiments, is provided. The floating structure 100 includes an open top end 102; an open bottom end 104 opposite the open top end 102; an annular wall 106 extending between the open top end 102 and the open bottom end 104; and a cylindrical structure 108 arranged off center of the floating structure 100 and configured to support a tower (not shown in FIG. 1A), as denoted by a line 110. The annular wall 106 may form a circumferential peripheral of the floating structure 100 to provide a central moonpool. At least part of the cylindrical structure 108 extends alongside and coupled to the annular wall 106. The cylindrical structure 108 may be constructed and dimensioned in a manner such that when the cylindrical structure 108 is coupled to the tower, vertical forces exerted by the tower may be transferred to the floating structure 100 via the cylindrical structure 108, for example, in a form of shear forces in the annular wall 106.

The floating structure 100 may be cylindrical having a central axis. As such, the central moonpool may be located around or about the central axis, and the cylindrical structure 108 being coupled to the annular wall 106 may be located away from the central axis.

In other words, there is provided the floating structure 100 with the central moonpool, where a vertical tower (e.g., a wind turbine tower) may be connected to the cylindrical structure 108 integrated in the side of the floating structure 100, more specifically, disposed on the sidewall (the annular wall 106) of the floating structure 100 or extending alongside the sidewall. Unlike the disclosures of prior publications such as US2020300224A1 and CN 112177859A, where a wind turbine tower sits on a deck of the support structure, the cylindrical structure 108 as described herein, which itself does not sit on top of or over the annular wall 106 in a vertical orientation, or along a plane of the open top end 102, does not cause a tower to be seated on a deck of the floating structure 100. The cylindrical structure 108 may be a cylindrical support structure or transition piece that transfers the vertical forces from the tower to the side(s) or sidewall of the floating structure 100 as shear forces. The height of the cylindrical structure 108 may be determined by the vertical forces from the tower and the necessary shear area to transfer the forces. For the cylindrical structure 108 to support or couple with the vertical tower, the cylindrical structure 108 is orientated vertically and substantially parallel to the central axis of the floating structure 100 or to the vertical tower. Essentially, the tower may be supported by a foundation provided by the floating structure 100.

The annular wall 106 extends upwardly from the open bottom end 104 to the open top end 102 to provide a vertical wall or sidewall of the floating structure 100. In one example, the open top end 102 may be a deck plate with a central opening coupled to a top end of the annular wall 106, as denoted by a line 112, while the open bottom end 104 may be a keel plate with a central opening coupled to a bottom end of the annular wall 106, as denoted by a line 114. Each central opening of the deck plate and the keel plate may have a diameter that substantially matches an inner diameter of the annular wall 106, which may also define the diameter of the central moonpool. In another example, the annular wall 106 may be presented with a predefined thickness, and when positioned in a vertical orientation, the annular wall 106 as seen from a top view (e.g. in direction T of FIG. 3), showing a top end of the annular wall 106 with an opening about its center, defines the open top end 102, while the annular wall 106 as seen from a bottom view (e.g. in direction U of FIG. 3), showing an underneath or a bottom end of the annular wall 106 with an opening about its center, defines the open bottom end 104.

In various embodiments, the floating structure 100, when positioned in the vertical orientation, may have a substantially circular, or substantially rectangular, or substantially polygonal horizontal cross-section. In other words, the floating structure 100 may have a planform that is substantially circular, or multifaced, e.g. substantially rectangular, or substantially polygonal.

In one example, the circumferential peripheral formed by an inner surface (or inner wall) of the annular wall 106 may follow a shape of the circumferential peripheral formed by an outer surface (or outer wall) of the annular wall 106. This may occur when the thickness of the annular wall 106 is regular. In a different example, the circumferential peripheral formed by the inner surface of the annular wall 106 may differ from a shape of the circumferential peripheral formed by the outer surface of the annular wall 106. This may occur when the thickness of the annular wall 106 is irregular.

Figure 11A:
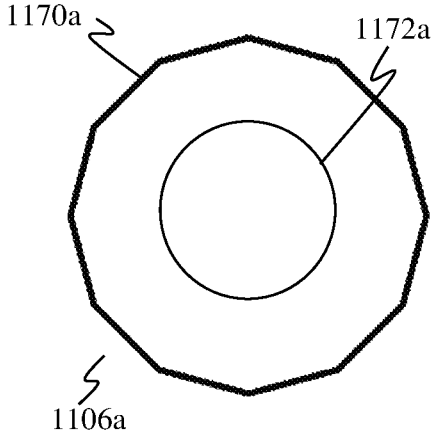
FIG. 11A shows a simplified schematic top view of an annular multifaced wall of a floating structure, without skirt, according to one embodiment.
Figure 11B:
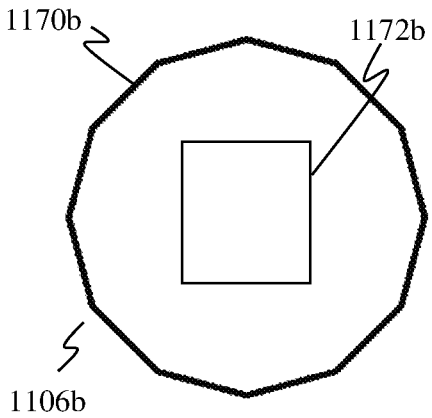
FIG. 11B shows a simplified schematic top view of an annular multifaced wall of a floating structure, without skirt, according to another embodiment.
Figure 11C:
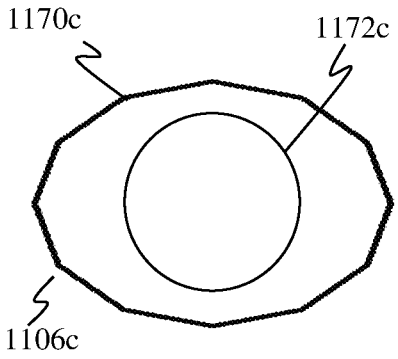
FIG. 11C shows a simplified schematic top view of an annular (irregular-shaped) multifaced wall of a floating structure, without skirt, according to one embodiment.
Figure 11D:
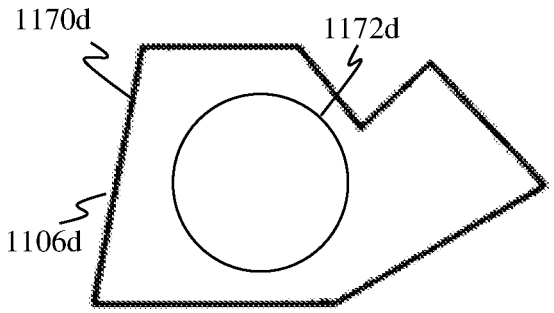
FIG. 11D shows a simplified schematic top view of an annular (irregular-shaped) multifaced wall of a floating structure, without skirt, according to another embodiment.

Some non-limiting examples of annular walls with inner surfaces having different circumferential peripherals as compared to outer surfaces are shown in FIGS. 11A to 11D. FIG. 11A shows a simple top view of an annular wall 1106*a* with a regular 12-sided polygonal outer surface 1170*a* and a circular inner surface 1172*a*. FIG. 11B shows a simple top view of an annular wall 1106*b* with a regular 12-sided polygonal outer surface 1170*b* and a squarish inner surface 1172*b*. FIG. 11C shows a simple top view of an annular wall 1106*c* with an irregular 12-sided polygonal outer surface 1170*c* and a circular inner surface 1172*c*. FIG. 11D shows a simple top view of an annular wall 1106*d* with an irregular 7-sided polygonal outer surface 1170*d* and a circular inner surface 1172*d*.

The annular wall 106 may have an inner effective diameter and an outer effective diameter, the inner effective diameter being greater than half of the outer effective diameter, thereby enabling a large moonpool to be provided.

It should be appreciated and understood that a diameter is any straight line or chord that passes through the center of a shape and terminating at the periphery. In the context of various embodiments, the phrase "inner effective diameter" refers to a first straight line passing through the center of the annular wall 106 and terminating at the periphery of the inner surface of the annular wall 106, and the phrase "outer effective diameter" refers to a second straight line passing through the center of the annular wall 106 and terminating at the periphery of the outer surface of the annular wall 106, wherein the first and second straight lines are of the same orientation, and the second straight line entirely overlaps the first straight line.

Various embodiments of the annular wall 106 described herein relate to a continuous structure. However, it should be understood and appreciated that the annular wall 106 can also take the form of a continual structure where part(s) of the annular wall 106 may include gaps.

In various embodiments, the cylindrical structure 108 may have a top portion arranged toward the open top end 102 of the floating structure 100, and a base opposite to the top portion, the base being arranged towards the open bottom end 104 of the floating structure 100. In one example, the base may be arranged flushed with the open bottom end 104 of the floating structure 100, thereby allowing at least part of the cylindrical structure 108 to extend along the entire height of the annular wall 106. In another example, the base may be arranged away or short from the open bottom end 104 of the floating structure 100, meaning that the base does not reach the open bottom end 104. In such a case, at least part of the cylindrical structure 108 may be extended along the height of the annular wall 106 only in part.

In one embodiment, each of the top portion and the base may be open-ended to allow a lower portion of the tower to pass through and out of the cylindrical structure 108. Here, the cylindrical structure 108 may be essentially through-hole. In a different embodiment, the base may have a closed bottom such that the lower portion of the tower received within the cylindrical structure 108 sits on the closed-bottom base.

The cylindrical structure 108 may be dimensioned and arranged in a manner such that the top portion may be protruded upwardly and exteriorly, spaced apart from the open top end 102 of the floating structure 100. In other words, the top portion of the cylindrical structure 108 may protrude or extend above or over the open top end 102, and thus, this top portion alone may be said not to be contained by the annular wall 106.

Figure 2A:
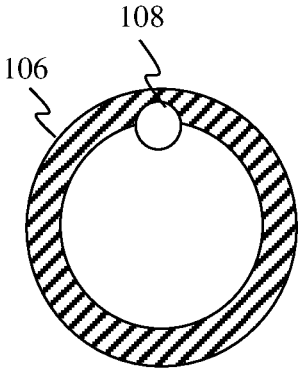
FIG. 2A shows a schematic top view of an annular wall with a cylindrical structure, according to one embodiment.

In one embodiment, the annular wall 106 may include a recess formed in an inner surface of the annular wall 106, the recess being shaped and dimensioned to receive a first part of the cylindrical structure 108 within the annular wall 106 or the recess, with a remaining second part of the cylindrical structure 108 extending or protruding outwardly, from the inner surface, as seen in an example of FIG. 2A.

In the context of various embodiments, the term "outwardly" may mean sideways or laterally with respect to the vertically upward annular wall 106.

Figure 2B:
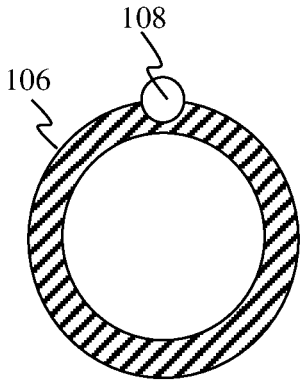
FIG. 2B shows a schematic top view of an annular wall with a cylindrical structure, according to a different embodiment.

In another embodiment, the annular wall 106 may include a recess formed in an outer surface of the annular wall 106, the recess being shaped and dimensioned to receive a first part of the cylindrical structure 108 within the annular wall 106 or the recess, with a remaining second part of the cylindrical structure 108 extending or protruding outwardly from the outer surface, as seen in an example of FIG. 2B.

Figure 2C:
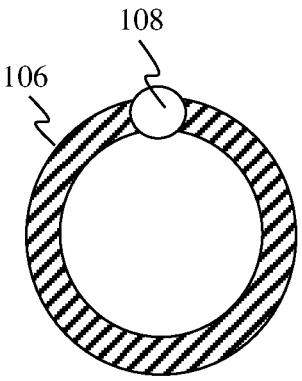
FIG. 2C shows a schematic top view of an annular wall with a cylindrical structure, according to yet another different embodiment.

In yet another embodiment, the annular wall may include a recess formed across the annular wall 106, the recess being shaped and dimensioned to receive a middle part of the cylindrical structure 108 within the annular wall 106 or the recess, with a first side part of the cylindrical structure 108 extending outwardly from an outer surface of the annular wall 106 and a second side part of the cylindrical structure 108 extending outwardly from an inner surface of the annular wall 106, as seen in an example of FIG. 2C. The first side part may be opposite to the second side part. The first side part, the second side part and the middle part made with reference to a longitudinal axis of the cylindrical structure 108.

In some embodiments (not shown in FIGS. 2A to 2C), the cylindrical structure 108 may have a diameter that is much smaller than the thickness of the annular wall 106, thereby allowing the cylindrical structure 108 to be arranged within the annular wall 106, that is without any sideway protrusion, but with the top portion of the cylindrical structure 108 remaining accessible to receive and support the tower.

A typical shear connection may include a support, a connector, and a beam. The support may be a girder (or a separate beam), a column flange, or a column web. The connector may be bolted or welded to the support and to the beam. In various embodiments, the cylindrical structure 108 may be coupled to the annular wall 106 via vertical shear connections. By doing so, vertical forces exerted by the tower may be transferred to the floating structure 100 via the cylindrical structure 108 in a form of shear forces in the annular wall 106. In one example, the vertical shear connections may be extended along an entire (or substantially entire) height of the cylindrical structure 108 where the cylindrical structure 108 couples to the annular wall 106. In another example, the vertical shear connections may be extended along the height of the cylindrical structure 108, where the cylindrical structure 108 couples to the annular wall 106, only in part. Not limiting to the examples mentioned, the vertical shear connections may be provided in a continuous form or a continual form at regular intervals or irregular intervals.

The floating structure 100 may include a fastening means configured to secure the tower to the floating structure 100. For example, the tower may be connected to the top of the cylindrical structure 108 (near or at its top portion). The cylindrical structure 108 may transfer forces and moments from the tower to the floating structure 100. The height of the cylindrical structure 108 may be dependent or governed by the vertical loads and moment transferred from the tower. The moment may be governed by the height of tower and weight of the turbine (including nacelle and blades) and tower.

For example, the fastening means may be provided by a connection between the tower and the cylindrical structure 108 such as a welded connection, a flange connection, a slip joint connection or other type of connection.

In various embodiments, the floating structure 100 may further include a skirt coupled towards the open bottom end 104 of the floating structure 100. The skirt may be coupled to at least one of: an outer surface of the annular wall 106; or an inner surface of the annular wall 106. The skirt may be of a height that allows the skirt to be entirely immersed below an initial waterline when the floating structure 100 is deployed in water. The skirt may be continuously, or optionally continually, coupled around the floating structure 100.

In one example, the skirt may include a plate or an open structure without buoyancy. In an alternative example, the skirt may include a closed structure to provide buoyancy.

The skirt may have a right-angle triangular vertical cross-section where a base (or adjacent side) of the skirt may be arranged in alignment, or flushed with the open bottom end 104 of the floating structure 100, the opposite side of the skirt may be arranged in contact with the outer surface of the annular wall 106 and secured thereto, with the hypotenuse of the skirt sloping outwardly towards the open bottom end 104. The opposite side of the skirt may refer to the right angle side that is substantially perpendicular to the base of the skirt.

The skirt may be of a continuous form surrounding the annular wall 106, or the skirt may be provided by a plurality of short skirts continually surrounding the annular wall 106. The skirt may be supported by columns, hopper plate, or by bracing.

In various embodiments, the floating structure 100 may be configured in a manner such that, in water, when the floating structure 100 moves at a natural period in heave, due to waves with the same period, vertical motion of a mass of water in the central moonpool moves with the same phase as the waves. The floating structure 100 may further be configured in a manner such that a natural period $T_{piston}$ of a vertical oscillation piston mode of the mass of water in the central moonpool is about 1.23 times (being less than 1.25 times) a natural period $T_{heave}$ of the floating structure 100 while the floating structure 100 is moving in heave.

The floating structure 100 may further include at least one of: ballast tanks to provide stability of the floating structure 100 when operating in water at different drafts; a mooring system including mooring lines arranged to be coupled to at least one of: the open top end 102, or the open bottom end 104, or the annular wall 106 of the floating structure 100; or a cable system including power cables for transmitting power arranged in the cylindrical structure 108.

The ballast tanks may be divided vertically or divided by a combination of vertical and horizontal watertight structures. Seawater may be used as ballast. The water ballast may be pumped in and out of each ballast tank by a ballast system mounted onboard the floating structure 100, or by pumping water in and out of each tank by use of a hose and a pump on a service vessel, or by use of a hose and a temporary pump on the floating structure 100.

Figure 1B:
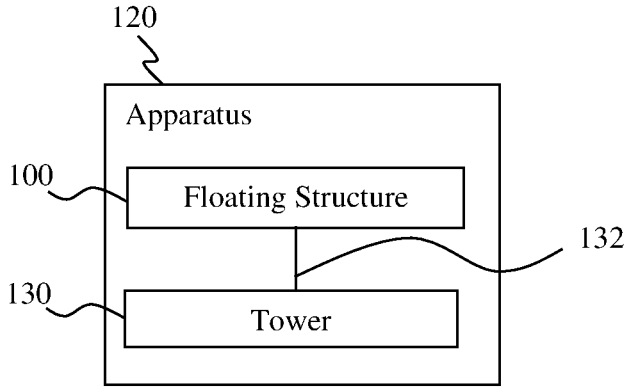
FIG. 1B shows a schematic view of an apparatus including the floating structure of FIG. 1A, according to various embodiments.

In FIG. 1B, there is provided an apparatus 120 including a floating structure 100 according to various embodiments; and a tower 130 supported by a cylindrical structure 108 of the floating structure 100, as shown by a line 132. A wind turbine may be attached to a distal end of the tower 130. The distal end is opposite to a base or portion of the tower 130 which is received at or by the cylindrical structure 108.

Examples of the floating structure and the apparatus including the same will be described in further details below.

Figure 3:
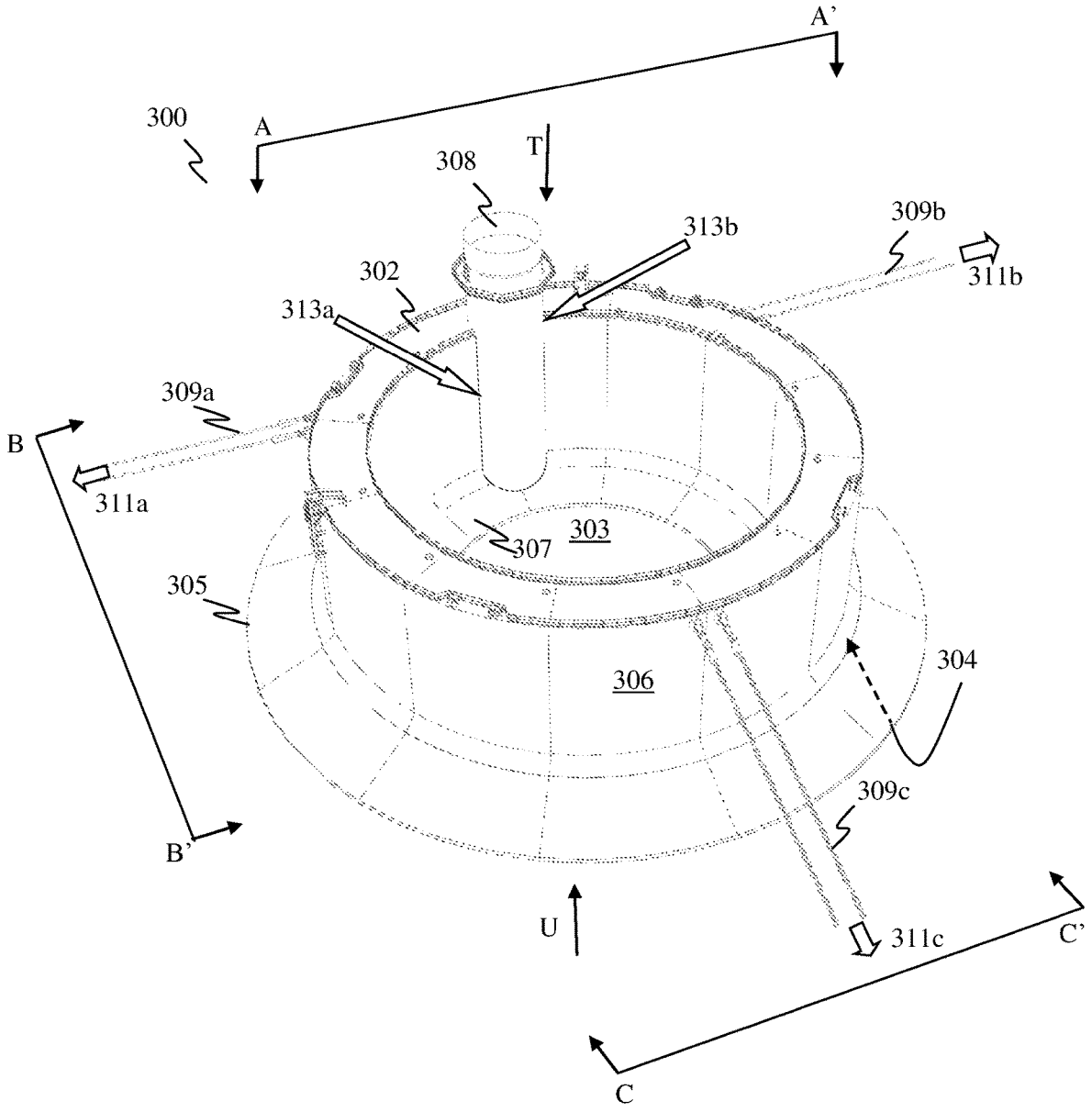
FIG. 3 shows a perspective view of a floating structure, according to one embodiment.
Figure 4:
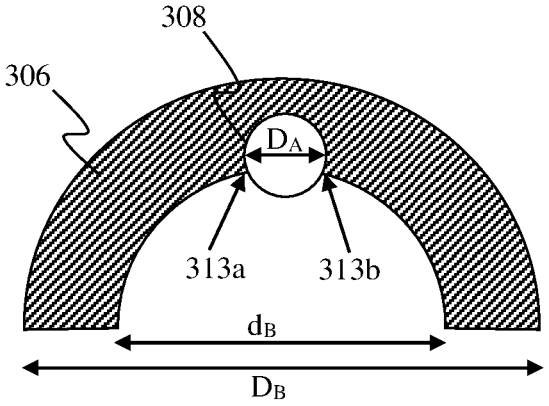
FIG. 4 shows a simplified schematic partial-half top view of the floating structure of FIG. 3, without skirt.

FIG. 3 shows a perspective view of a floating structure 300, according to one example, and FIG. 4 shows a simplified top view of the floating structure 300 in half part, as seen from line A-A'. The floating structure 300 may be deployed in deeper waters, with a tower 530 having a wind turbine 532 on top, wherein the tower 530 is received and supported by the floating structure 300, as seen in the apparatus 520 of FIG. 5.

The floating structure 300 may include the same or like elements or components as those of the floating structure 100 of FIG. 1A, and as such, the numerals with same ending numbers are assigned and the like elements may be as described in the context of the floating structure 100 of FIG. 1A, and therefore the corresponding descriptions are omitted here.

The floating structure 300 has a large moonpool where the diameter of the inner surface or inner wall, $d_B$, is greater than half of the diameter of the outer surface or outer wall, $D_B$ (i.e. $d_B > D_B/2$). The floating structure 300 may have a cylindrical shape and an annular wall 306 defining a central moonpool 303. The annular wall 306 may be of substantially constant height around the circumferential peripheral of the floating structure 300. In other examples (not shown in the figures), the floating structure 300 may have a different shape, and/or the annual wall 306 may be of inconsistent height(s) around the circumferential peripheral of the floating structure 300, but still providing a central moonpool.

The floating structure 300 (interchangeably referred to as a floating foundation) for the turbine may be a small waterplane area cylindrical hull (SWACH). For the SWACH: when the floating structure 300, being a buoyant body, moves at the natural period in heave, due to waves with the same period, then the vertical motion of the water in the central moonpool 303 moves with the same phase as the waves. The SWACH may be characterized (in arbitrary unit) by Equation 1, as follow:—

$$\sqrt{\frac{\rho S_o\left(d + 0.52\sqrt{S_1}\right)}{M + M_a}} \qquad \text{Equation 1}$$

An example of relevant parameters is shown in Table 1.

TABLE 1

| Description | Abbreviation | Value | Units |
|---|---|---|---|
| Water density | $\rho$ | 1.025 | $t/m^3$ |
| Water plane area of hull of the floating structure 300 | $S_0$ | 1,360.90 | $m^2$ |
| Water plane area of the central | $S_1$ | 2,164.80 | $m^2$ |

TABLE 1-continued

| Description | Abbreviation | Value | Units |
|---|---|---|---|
| moonpool 303 | | | |
| Draft of the floating structure 300 | d | 20 | m |
| Mass of the floating structure 300 | M | 27,898 | t |
| Added mass | Ma | 0.45 × M < Ma < 0.85 × M | t |

The hull of the floating structure 300 may include the annular wall 306, the open top end 302, the open bottom end 304, and the cylindrical structure 308. The added (hydrodynamic) mass may optionally be increased by including an outer skirt 305 or an inner skirt 307. Added mass may vary as a function of the shape and/or volume of the floating body 300, and other factors computed by, e.g. a recognised diffraction-radiation code.

The heave natural period and piston mode period of the SWACH may be determined as follow.

Moonpool piston mode may be based on Molin formula, and calibrated against model test using Equation 2:—

$$\omega_o \cong \sqrt{\frac{g}{h+\left(\frac{b}{\pi}\right)\left(\frac{3}{2}+\ln\frac{H}{2b}\right)}} \qquad \text{Equation 2}$$

where b is the diameter of the moonpool, h is the draft, and g represents acceleration due to gravity.

The position of two sinks, ±H is optimized by numerical analysis. H may be calibrated against model test: H=6.5×Dh, where Dh represents hull diameter.

Piston mode period, $T_{piston}$ may be calculated using Equation 3:—

$$\frac{2\pi}{\sqrt{\frac{g}{h+\left(\frac{b}{\pi}\right)\left(\frac{3}{2}+\ln\frac{H}{2b}\right)}}} \qquad \text{Equation 3}$$

where b is the diameter of the moonpool, h is the draft, and g represents acceleration due to gravity.

For example, where undamped eigenperiod in heave, $T_{heave}$ is 18.5 s, and using the relevant parameters provided above, the ratio of $T_{heave}$ and $T_{piston}$, $$\frac{T_{heave}}{T_{piston}},$$

may be about 1.23, but not equal to or more than 1.25.

As seen in FIG. 4, the cylindrical structure 308 with diameter $D_A$ is connected to the annular wall 306 with outer diameter (outer effective diameter) $D_B$ and inner diameter (inner effective diameter) $d_B$, where $D_A \ll D_B$. Generally, the cylindrical structure 308 is of a thickness that may be less than its diameter, and significantly smaller than the outer diameter (outer effective diameter) of the annular wall 306. For simplicity, $D_A$ may represent the outer diameter of the cylindrical structure 308.

In some embodiments, a section of the annular wall 306 below the tower 530 may also be extended in thickness. The cylindrical structure 308 may also provide additional buoyancy below the tower 530 and reducing the need for rightening ballast on a side of the floating structure 300 opposite to the location of the cylindrical structure 308.

The cylindrical structure 308 may be coupled to the inner surface of the annular wall 306 using shear connections 313*a*, 313*b*. The shear connections 313*a*, 313*b* may be vertical shear connections disposed across an interface where the cylindrical structure 308 protrudes sideway and outwardly from the annular wall 306. In FIGS. 3 and 4, the shear connections 313*a*, 313*b* are welded between the cylindrical structure 308 and the inner side of the annular wall 306. In different embodiments, for example in FIG. 2B, the shear connections may be welded between the cylindrical structure 108 and the outer side of the annular wall 106, while for example in FIG. 2C, the shear connections may be welded between the cylindrical structure 108 and both the inner and outer sides of the annular wall 106. The shear connections may be provided along at least part of the height of the cylindrical structure 308 or at least part of the height of the annular wall 306. For example, the shear connections 313*a*, 313*b* may be provided near the open top end 302 and near the open bottom end 304. In another example, the shear connections 313*a*, 313*b* may be provided along substantially the entire interface from the open top end 302 to the open bottom end 304.

Vertical forces and moments may be transferred from the cylindrical structure 308 to the annular wall 306. For example, the vertical forces from the tower 530 may be transferred to the floating structure 300 via the cylindrical structure 308 as shear forces in the side of the floating structure 300, that is the annular wall 306. In other words, the vertical forces may be transferred from the cylindrical structure 308 to the annular wall 306 through the vertical shear connections between the cylindrical structure 308 and the annular wall 306.

In effect, the vertical shear connections transfer the vertical forces from the tower 530 and the wind turbine 532 to the floating structure 300. The vertical shear connections may be disposed or made between the cylindrical structure 308 and one of the following: the inner surface of the annular wall 306 (also see FIG. 4), or the outer surface of the annular wall 306 (making comparative reference to FIG. 2B), or both the inner and outer surfaces of the annular wall 306 (making comparative reference to FIG. 2C).

The cylindrical structure 308 may be orientated vertically and substantially parallel to a central axis of the floating structure 300 or to the tower 530.

Moment may be transferred via horizontal stringers and decks in the floating structure 300.

Figure 13:
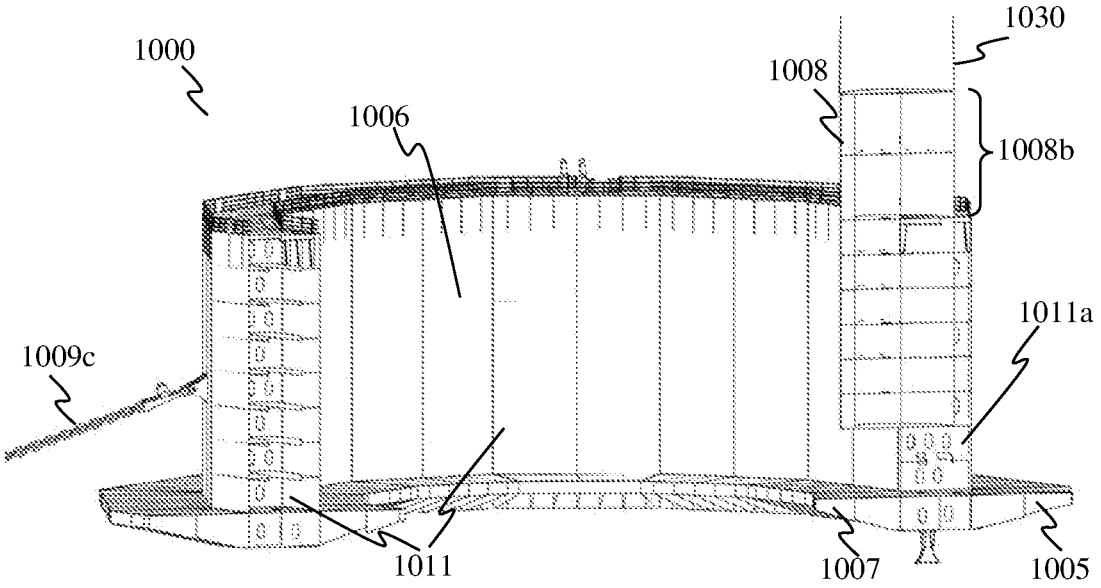
FIG. 13 shows a cross-sectional perspective view of the floating structure of FIG. 10A viewed from line E.

The floating structure 300 may be equipped with a mooring system. Mooring lines 309*a*, 309*b*, 309*c* may be attached on top of the floating structure 300, e.g. near or at the open top end 302. The mooring lines 309*a*-309*c* may be grouped in three equally spaced mooring clusters 311*a*, 311*b*, 311*c*, with one or more line 309*a*-309*c* in each cluster 311*a*-311*c*. In a different example, the mooring lines 309*a*-309*c* may alternatively or additionally be connected at a lower part of the floating structure 300, e.g. near or at the open bottom end 304, and/or at intermediate positions along the annular wall 306, that is, between the open top end 302 and the open bottom end 304 (for example, as shown in FIGS. 10 and 13).

Figure 5:
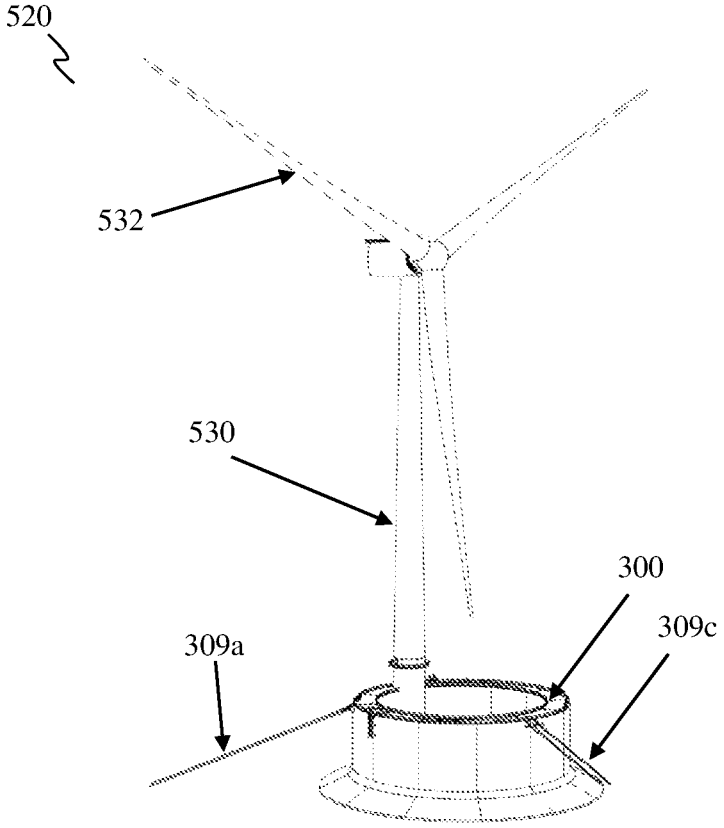
FIG. 5 shows a perspective view of an apparatus including the floating structure of FIG. 3.
Figure 6A:
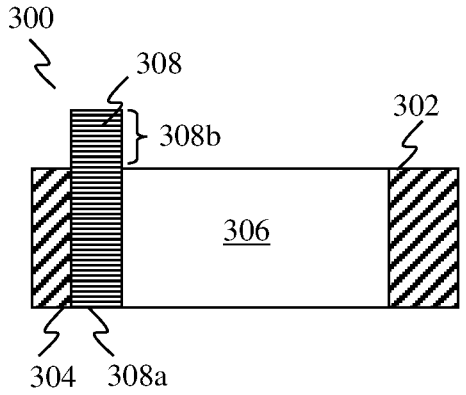
FIG. 6A shows a simplified vertical cross-sectional side schematic view of the floating structure of FIG. 3 as seen from line B-B', without skirt.
Figure 6B:
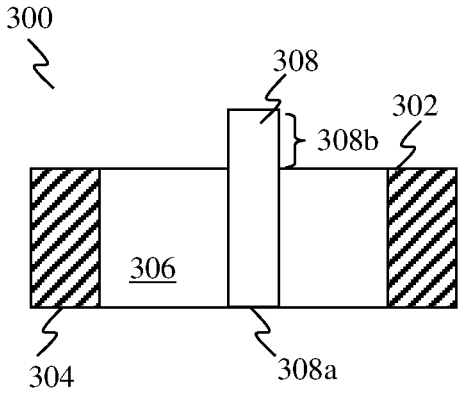
FIG. 6B shows a vertical cross-sectional front schematic view of the floating structure of FIG. 3 as seen from line C-C', without skirt.

In FIGS. 3 to 5, a part of the cylindrical structure 308 is arranged extending along substantially the entire height of the annular wall 306. As can be seen in FIGS. 6A and 6B showing a vertical cross-sectional side schematic view of the floating structure 300 as seen from line B-B' and a vertical cross-sectional front schematic view of the floating structure 300 as seen from line C-C', the base 308*a* of the cylindrical structure 308 may be arranged aligned with or flushed with the open bottom end 304, while the top portion 308*b* (opposite the base 308*a*) may be extended or protruded above the open top end 302.

Figure 7A:
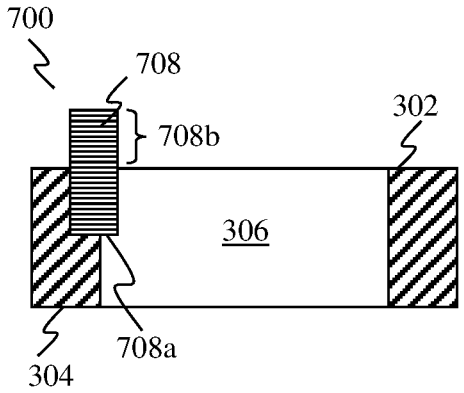
FIG. 7A shows a simplified vertical cross-sectional side schematic view of a floating structure, according to one embodiment, without skirt.
Figure 7B:
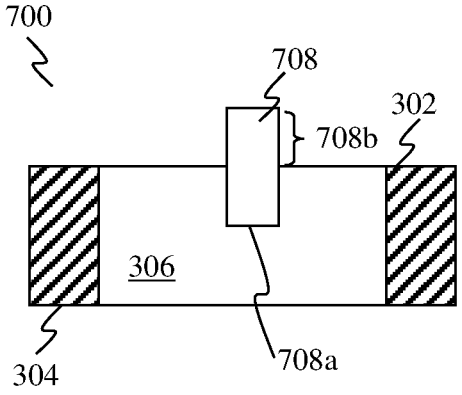
FIG. 7B shows a vertical cross-sectional front schematic view of the floating structure of FIG. 7B, without skirt.

In an alternative configuration, as shown in a vertical cross-sectional side schematic view of a floating structure 700 of FIG. 7A, and a vertical cross-sectional front schematic view of the floating structure 700 of FIG. 7B, a part of a cylindrical structure 708 is arranged extending along the height of the annular wall 306 in part, for example, at approximately halfway or any point that may be necessary to carry a vertical load, e.g. allowing the cylindrical structure 708 to provide sufficient support to the tower 530. In other words, the base 708*a* of the cylindrical structure 708 may be arranged away (spaced apart) from the open bottom end 304, while the top portion 708*b* (opposite the base 708*a*) may be extended or protruded above the open top end 302.

The floating structure 700 may include the same or like elements or components as those of the floating structure 100 of FIG. 1A, and as such, the numerals with same ending numbers are assigned and the like elements may be as described in the context of the floating structure 100 of FIG. 1A, and therefore the corresponding descriptions are omitted here.

Figure 8A:
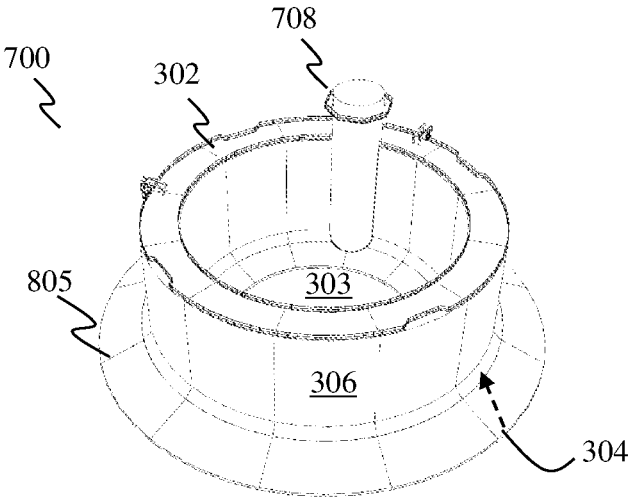
FIG. 8A shows a perspective view of a floating structure, according to one embodiment.
Figure 8B:
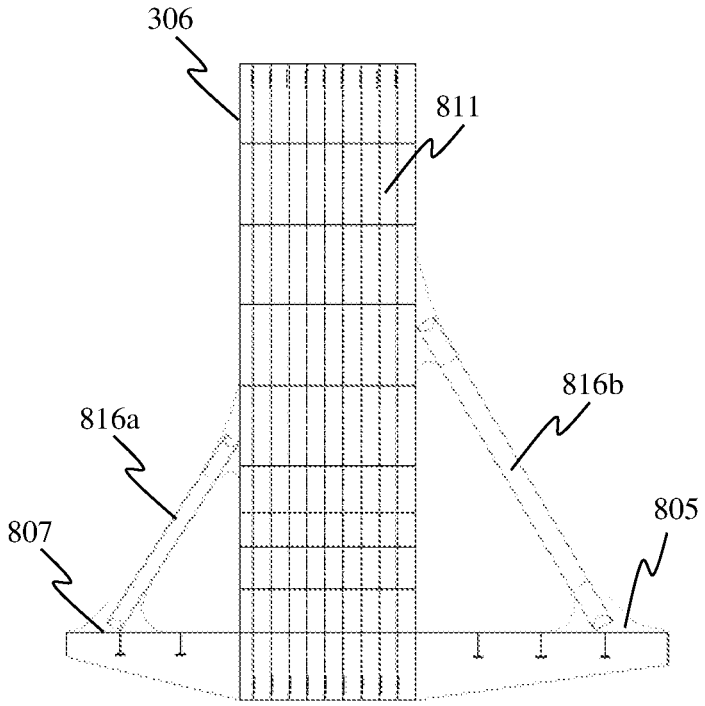
FIG. 8B shows a cross-sectional side view illustrating part of an annular wall with supported skirts, according to various embodiments.
Figure 8C:
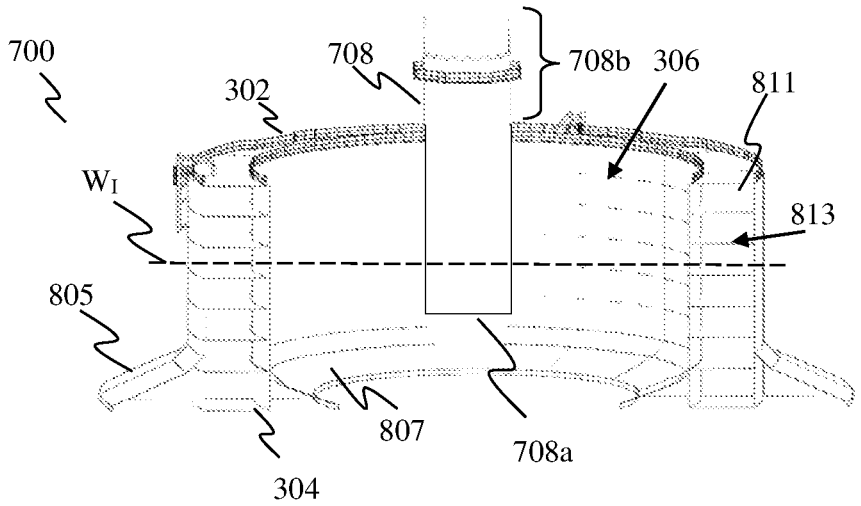
FIG. 8C shows a vertical cross-sectional front view of the floating structure of FIG. 8A.

FIGS. 8A and 8C show a perspective view and a vertical cross-sectional front view of the floating structure 700, respectively, with skirts 805, 807 included.

Similar to the floating structure 300 of FIG. 3, on a lower part of the floating structure 700, more specifically, a lower part of the outer surface of the annular wall 306, a skirt 805 may be mounted to provide an outer skirt. The outer skirt 305, 805 may run throughout the outer circumference of the floating structure 300, 700 and may be continuous or separated in several smaller skirts (not shown in figures). Alternatively or additionally, on the lower part, a skirt 807 may be mounted on the inner surface of the annular wall 306, i.e. inside the moonpool, to provide an inner skirt. The inner skirt 307, 807 may run throughout the inner circumference of the floating structure 300, 700 and may be continuous or separated in several smaller skirts (not shown in figures).

It should be noted that while the features described below may make reference to the figures illustrating the floating structure 700, these features are similarly applicable to the floating structure 300 of FIG. 3A.

The floating structure 300, 700 may have the outer skirt 305, 805 below an initial waterline, $W_I$, as represented in FIG. 8C.

The floating structure 300, 700 may have the inner skirt 307, 807 below the initial waterline, $W_I$, as represented in FIG. 8C.

The skirt (outer skirt 305, 805 or inner skirt 307, 807) may be a plate or an open structure without buoyancy. In a different example, the skirt (outer skirt 305, 805 or inner skirt 307, 807) may be closed and provide buoyancy.

The skirt (outer skirt 305, 805 or inner skirt 307, 807) may be supported by columns or hopper plate, or by bracing. FIG. 8B shows a cross-sectional side view illustrating part of the annular wall 306 with ballast tanks 811 and skirts 805, 807 supported by columns 816*b*, 816*a*.

Figure 9A:
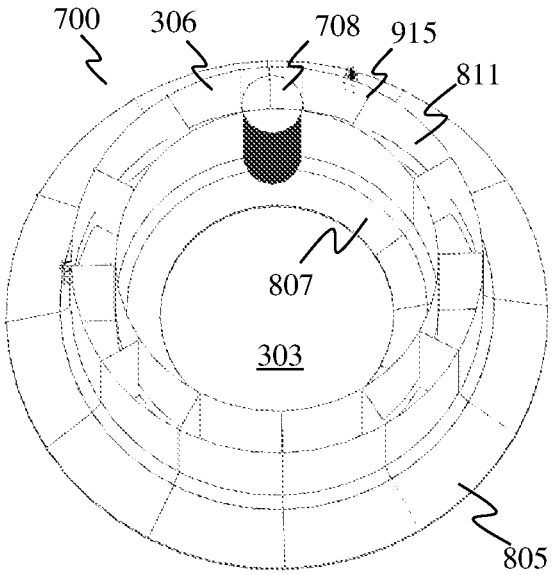
FIG. 9A shows a perspective view of the floating structure of FIG. 8A, with a top portion being cut-off horizontally.
Figure 9B:
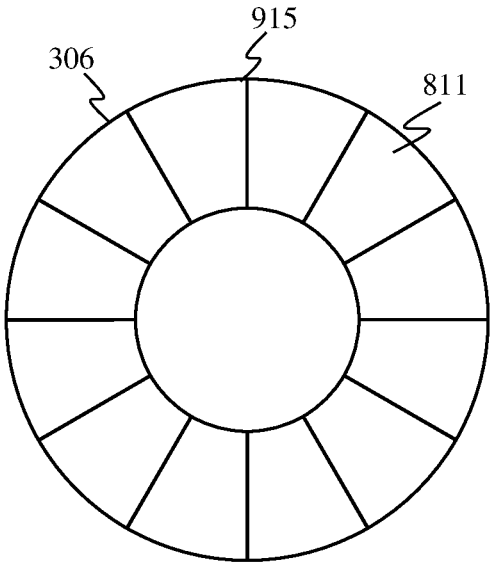
FIG. 9B shows a simplified horizontal cross-sectional plan schematic view of the annular wall of the floating structure of FIG. 8A.

FIG. 9A shows a perspective view of the floating structure 700, with a top portion being cut-off horizontally to expose an exemplary inner configuration of the annular wall 306. FIG. 9B shows a simplified horizontal cross-sectional plan view of the annular wall 306 as seen in FIG. 9A, without the cylindrical structure 708.

With reference to FIGS. 8C, 9A and 9B, the floating structure 700 may be equipped with the ballast tanks 811 to provide sufficient stability and to operate the floating structure 700 at various drafts. The floating structure 700 may be divided into several ballast tanks 811 as necessary for stability. The tanks 811 may be divided vertically by vertical watertight structures 915, or divided by a combination of vertical watertight structures 915 and horizontal watertight structures 813. In FIG. 9B, the vertical watertight structures 915 are arranged to divide into twelve parts. However, it should be understood and appreciated that other arrangements may be used for division into different numbers of parts. Seawater may be used as ballast. The water ballast may be pumped in and out of each ballast tank 811 by a ballast system (not shown in figures) mounted onboard the floating structure 700, or by pumping water in and out of each tank 811 by use of a hose and a pump on a service vessel (not shown in figures), or by use of a hose and a temporary pump on the floating structure 700 (not shown in figures).

For example, the floating structure 700 may be divided into several identical watertight tanks (e.g. 811) and one watertight compartment that contains the cylindrical structure 708. The watertight compartment may be provided between two adjacent vertical watertight structures 915. Substantially identical watertight tanks (e.g. 811) may ease mass production, logistics and assembly.

Figure 10A:
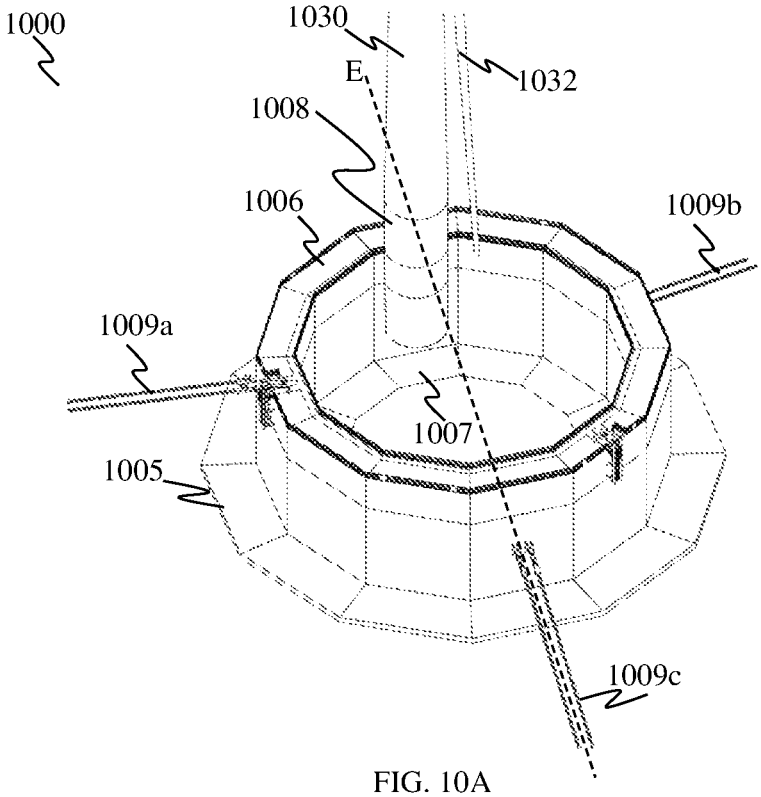
FIG. 10A shows perspective view of a floating structure including an annular multifaced wall and supporting a tower, according to various embodiments.

FIG. 10A shows a floating structure 1000, similar to the floating structure 700 as shown in FIG. 8A but having an annular wall 1006 that is 12-sided polygonal and coupled to a cylindrical structure 1008 to receive and support a tower 1030 of a wind turbine 1032. Mooring lines 1009*a*, 1009*b*, 1009*c* may be attached at intermediate positions along the annular wall 1006 between the open top end and the open bottom end of the floating structure 1000.

Figure 10B:
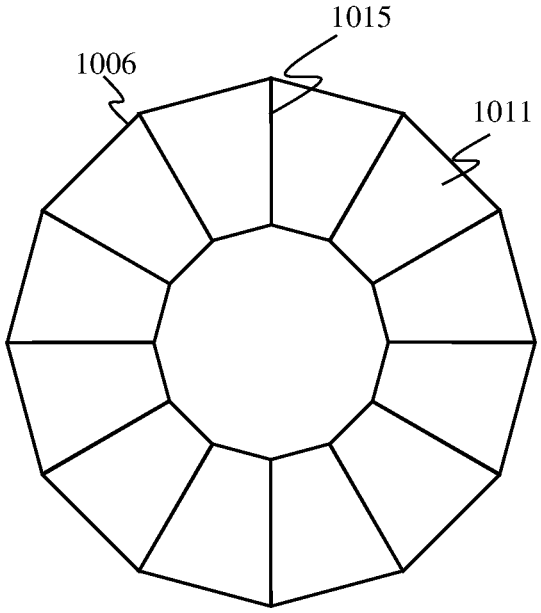
FIG. 10B shows a simplified horizontal cross-sectional plan schematic view of the annular multifaced wall of FIG. 10A.

FIG. 10B shows a simplified top horizontal cross-sectional view of the annular wall 1006 without the cylindrical structure and skirts 1005, 1007. The floating structure 1000 may be equipped with ballast tanks 1011 to provide sufficient stability and to operate the floating structure 1000 at various drafts. The floating structure 100 may be divided into several ballast tanks 1011 as necessary for stability. The tanks 1011 may be divided vertically by vertical watertight structures 1015, or divided by a combination of vertical watertight structures 1015 and horizontal watertight structures (not shown in FIGS. 10A and 10B). In FIG. 10B, the vertical watertight structures 1015 are arranged to divide into twelve parts.

Figure 12A:
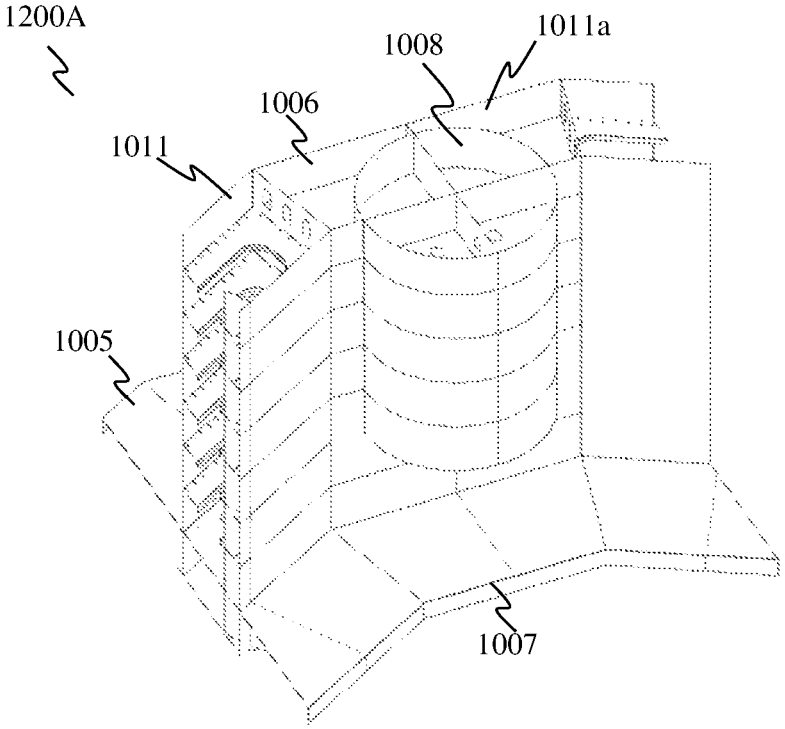
FIG. 12A shows a partial perspective view of the floating structure of FIG. 10A, with an upper portion horizontally cut-off.
Figure 12B:
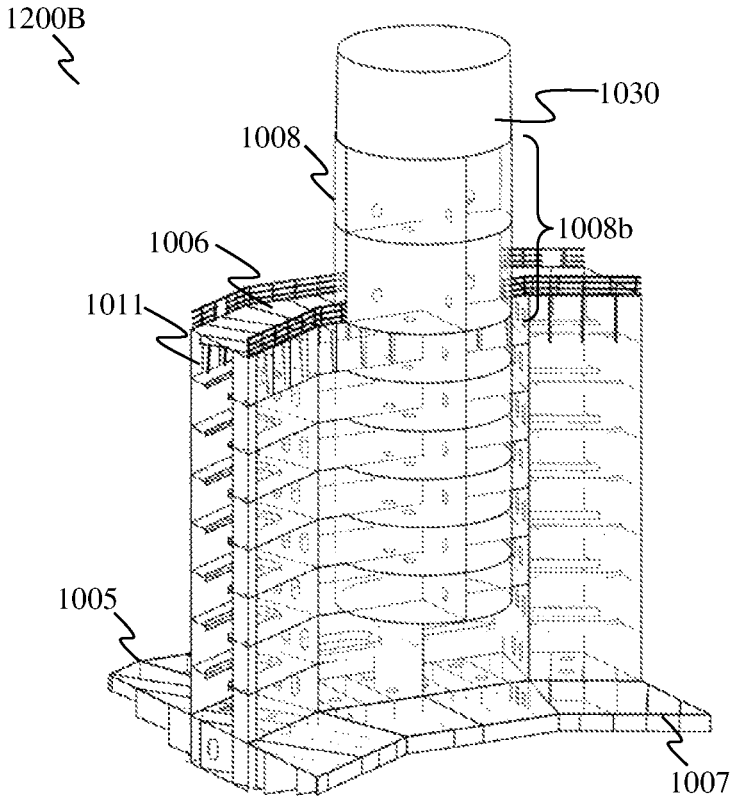
FIG. 12B shows a partial perspective see-through view of the floating structure of FIG. 10A.

FIG. 12A shows a partial perspective view 1200A of the floating structure 1000 of FIG. 10A, with an upper portion horizontally cut-off. FIG. 12B shows a see-through perspective view 1200B similarly to FIG. 12A, but including the upper portion. FIG. 13 shows a cross-sectional perspective view of the floating structure 1000 of FIG. 10A viewed from line E.

As seen in FIGS. 10A, 10B, 12A, 12B and 13, the design is divided into twelve tanks 1011 (or sections), closed in the bottom and top of the annular wall 1006. All tanks/colours 1011 are providing buoyancy. Eleven of the tanks/sections 1011 are more or less identical in design, while the section 1011*a* containing the cylindrical structure 1008 is different. The volume/buoyancy of this section 1011*a* may be increased by increasing the thickness of the annular wall 1006 or by the cylindrical structure 1008 extending outside the annular wall 1006, below the top of the annular wall 1006.

The tower 1030 is connected or coupled to an upwardly protruding top portion 1008*b* of the cylindrical structure 1008. Thus, the tower 1030 may be seen to be sitting on top of or over the cylindrical structure 1008 or the top portion 1008*b*.

In a different example (not shown in FIGS. 10A, 12A, 12B and 13), the interior of the cylindrical structure may not include any ballast tanks (thus empty, making it a hollow cylindrical structure).

The floating structure 700, 1000 may be equipped with a cable system for power transmission. Power cable(s) to/from the floating structure 700, 1000 may be arranged in the cylindrical structure 708, 1008 and means for pull-in and hang-off of the cable(s) may be provided (not shown in figures). The pull-in may be performed by a temporary winch or by a sheave system and a pull-in winch from a support vessel.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

The invention claimed is:

1. A floating structure comprising:

an open top end;

an open bottom end opposite the open top end;

an annular wall extending between the open top end and the open bottom end; and a single cylindrical structure arranged off center of the floating structure and configured to support a tower, wherein the annular wall is a continuous sidewall of the floating structure and forms a circumferential peripheral of the floating structure to provide a central moonpool, at least part of the single cylindrical structure extends alongside and is coupled to the annular wall, the single cylindrical structure is coupled to the annular wall via vertical shear connections, the single cylindrical structure is constructed and dimensioned in a manner such that when the single cylindrical structure is coupled to the tower, vertical forces exerted by the tower are transferred to the floating structure via the single cylindrical structure in a form of shear forces in the annular wall, and the floating structure has one of the following configurations:

an inner surface of the annular wall has a recess shaped and dimensioned to receive a first part of the cylindrical structure within the annular wall, with a remaining second part of the cylindrical structure extending or protruding outwardly from the inner surface;

an outer surface of the annular wall has a recess shaped and dimensioned to receive a first part of the cylindrical structure within the annular wall, with a remaining second part of the cylindrical structure extending or protruding outwardly from the outer surface;

the annular wall includes a recess thereacross, wherein the recess is shaped and dimensioned to receive a middle part of the cylindrical structure within the annular wall, with a first side part of the cylindrical structure extending outwardly from an outer surface of the annular wall and a second side part of the cylindrical structure extending outwardly from an inner surface of the annular wall, and the recess extending along the height of the annular wall in part and is terminated away from the open bottom end of the floating structure, thereby providing a remaining part of the annular wall as a continuous sidewall; or the cylindrical structure has a diameter that is smaller than a thickness of the annular wall, the cylindrical structure being arranged within the annular wall, without any sideway protrusion, but with a top portion of the cylindrical structure remaining accessible to receive and support the tower.

2. The floating structure as claimed in claim 1, wherein the floating structure has a substantially circular, or substantially rectangular, or substantially polygonal horizontal cross-section.

3. The floating structure as claimed in claim 1, wherein the annular wall has an inner effective diameter and an outer effective diameter, the inner effective diameter being greater than half of the outer effective diameter.

4. The floating structure as claimed in claim 1, wherein the single cylindrical structure has the top portion arranged towards the open top end of the floating structure, and a base opposite to the top portion, the base being arranged towards the open bottom end of the floating structure.

5. The floating structure as claimed in claim 4, wherein the base is arranged flushed with the open bottom end of the floating structure.

6. The floating structure as claimed in claim 1, wherein the single cylindrical structure is dimensioned and arranged in a manner such that the top portion is protruded upwardly and exteriorly, spaced apart from the open top end of the floating structure.

7. The floating structure as claimed in claim 1, wherein the floating structure comprises a fastening means configured to secure the tower to the floating structure.

8. The floating structure as claimed in claim 1, wherein the vertical shear connections are extended along an entire height of the single cylindrical structure.

9. The floating structure as claimed in claim 1, further comprising a skirt coupled towards the open bottom end of the floating structure.

10. The floating structure as claimed in claim 9, wherein the skirt is coupled to at least one of:

the outer surface of the annular wall; or the inner surface of the annular wall.

11. The floating structure as claimed in claim 9, wherein the skirt is of a height that allows the skirt to be entirely immersed below an initial waterline when the floating structure is deployed in water.

12. The floating structure as claimed in claim 9, wherein the skirt is continuously or continually coupled around the floating structure.

13. The floating structure as claimed in claim 9, wherein the skirt comprises a plate or an open structure without buoyancy.

14. The floating structure as claimed in claim 9, wherein the skirt comprises a closed structure to provide buoyancy.

15. The floating structure as claimed in claim 1, wherein the floating structure is dimensioned and shaped in a manner such that when in use, the floating structure moves in heave, and causes a natural period $T_{piston}$ of a vertical oscillation piston mode of a mass of water in the central moonpool to be less than a natural period $T_{heave}$ of the floating structure.

16. The floating structure as claimed in claim 1, further comprising at least one of:

ballast tanks configured to provide stability of the floating structure when operating in water at different drafts;

a mooring system comprising mooring lines arranged to be coupled to at least one of the open top end, or the open bottom end, or the annular wall of the floating structure; or a cable system comprising power cables for transmitting power arranged in the single cylindrical structure.

17. An apparatus comprising:

a floating structure as claimed in claim 1; and a tower supported by a single cylindrical structure of the floating structure, wherein a wind turbine is attached to a distal end of the tower.

* * * * *